US005292282A

United States Patent [19]

Callas

[11] Patent Number: 5,292,282

[45] Date of Patent: Mar. 8, 1994

[54] AIR GUARD

[76] Inventor: Mike T. Callas, 5701 Camelback Dr., Edina, Minn. 55436

[21] Appl. No.: 959,595

[22] Filed: Oct. 13, 1992

[51] Int. Cl.[5] ..... F24F 13/08

[52] U.S. Cl. ..... 454/292; 454/300; 454/306; 454/307

[58] Field of Search ..... 454/284, 289, 292, 300, 454/306, 307, 310

[56] References Cited

U.S. PATENT DOCUMENTS

| | | | |
|---|---|---|---|
| 3,386,367 | 6/1968 | Pellegrino | 454/302 |
| 3,502,016 | 3/1970 | Steele | 454/306 |
| 3,665,969 | 5/1972 | Clifford | 454/289 X |
| 4,481,871 | 11/1984 | Efstratis | 454/306 |
| 4,501,195 | 2/1985 | Held | 454/284 |
| 4,655,120 | 4/1987 | Lemmo | 454/306 X |

FOREIGN PATENT DOCUMENTS

| | | | |
|---|---|---|---|
| 1596188 | 4/1990 | U.S.S.R. | 454/292 |

*Primary Examiner*—Harold Joyce
*Attorney, Agent, or Firm*—Burd, Bartz & Gutenkauf

[57] ABSTRACT

An air guard assembly used to direct air forced through an overhead air diffuser toward the floor of a building. The assembly has a plurality of elongated linear baffles. Each baffle has a strip of magnetic material that adheres directly to metal ceiling structures to surround and enclose the diffuser within the assembly. A gripping tool having an elongated handle is used to locate the baffle adjacent the metal ceiling surface and remove the baffle therefrom. The baffle has a pair of grooves preventing the gripping tool from slipping off the baffle.

12 Claims, 4 Drawing Sheets

FIG.15
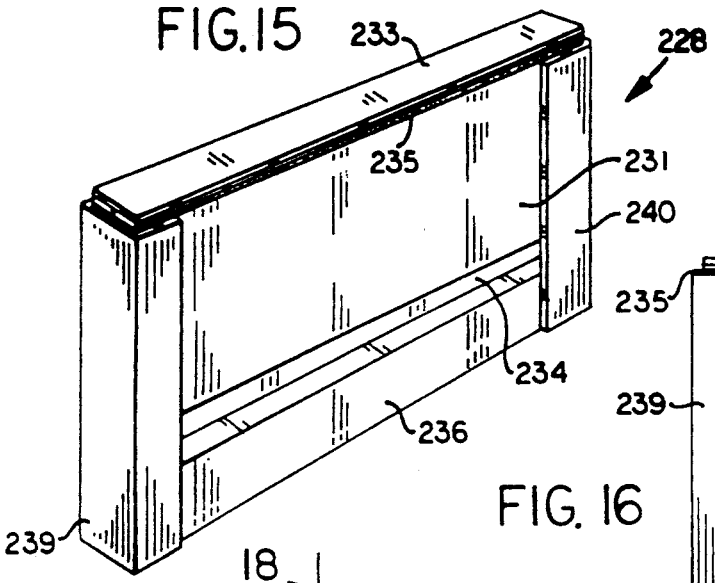
FIG. 16
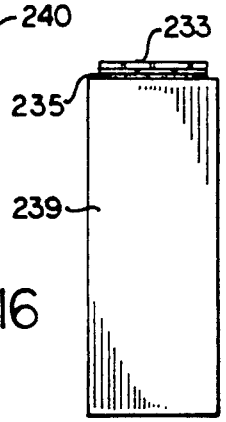
FIG. 18
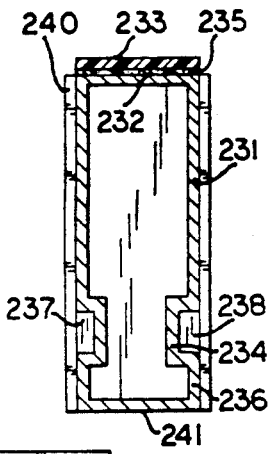
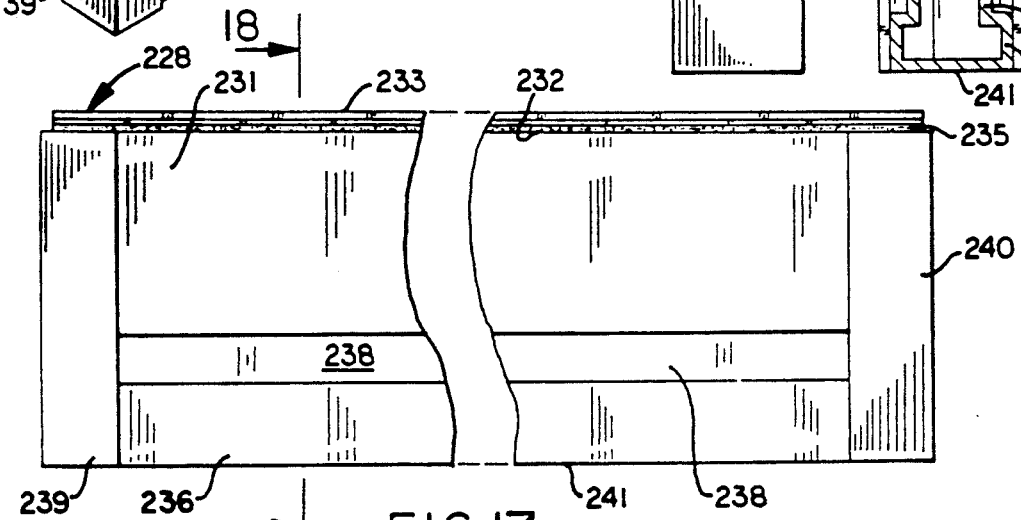
FIG.17
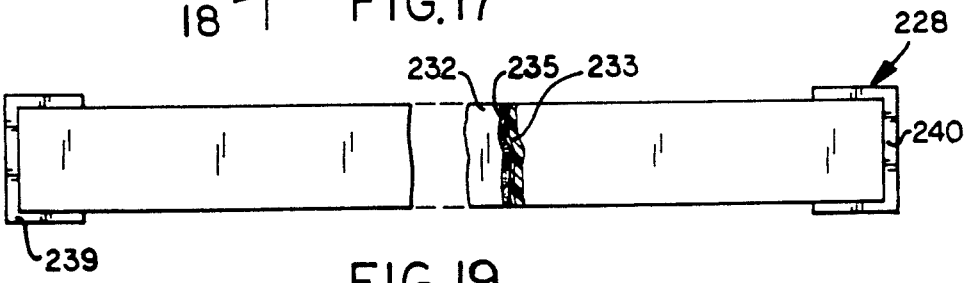
FIG.19
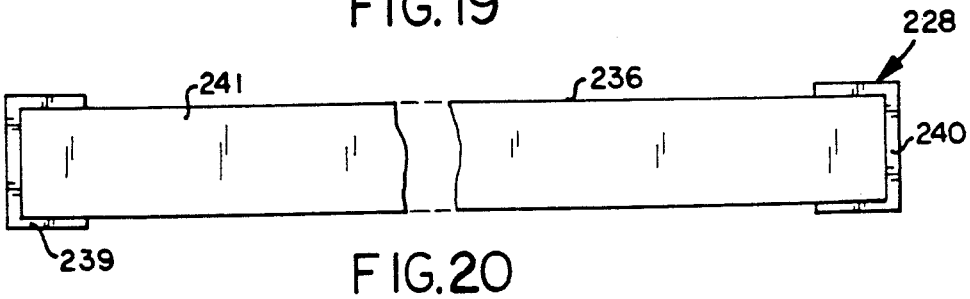
FIG.20

AIR GUARD

FIELD OF THE INVENTION

The invention relates to devices for directing moving air forced from heating and air conditioning vents in a building, particularly, air flow control devices having magnets that adhere directly to metal ceiling structures.

BACKGROUND OF THE INVENTION

Commonly, ceiling mounted air diffusing devices, called diffusers, are located adjacent the discharge ends of ventilation ducts in a building. These devices direct forced hot or cold air outwardly generally parallel to the ceiling surface. Panels of the ceiling located adjacent the diffusers often become soiled with sir born particulates, dust and dirt moving with the air flowing from the diffusers. Periodic cleaning and eventual replacement of the panels is required. Also, hot air flowing along the ceiling does not circulate downwardly to heat the space above the floor in a heat efficient manner.

SUMMARY OF THE INVENTION

The invention is directed to an air guard assembly that is magnetically supported on metal ceiling strips surrounding the perimeter of an overhead air diffuser. The air guard assembly directs air flow downward to prevent soiling of the panels adjacent the diffuser. Also, the assembly causes hot air to flow away from the ceiling thereby increasing heat energy efficiency. A tool operable from floor level is used to position the air guard assembly on the metal strips and remove the assembly therefrom.

The air guard assembly has a plurality of elongated linear air baffles positioned around the outer peripheral edge of an air diffuser mounted on a ceiling. The baffles are located in a tight close relationship around the diffuser to minimize leakage of air toward the ceiling panels. The ends of the baffles overlap to prevent leaking of air and dirt through the assembly. Each baffle has a tubular body having a flat top surface. A generally flat strip of plastic magnetic material is secured to the top surface of the body with an adhesive or like bonding material. The guard member has a neck for accommodating a gripping tool having an elongated handle. The gripping tool has jaws that engage opposite sides of the body or the neck joined to the body to facilitate handling of the baffle. The gripping tool is operable to locate the baffle on magnetic holding material adjacent the air diffuser. A transverse shoulder attached to the neck defines grooves for the gripping tool so that the gripping tool does not slip off the baffle during installation and removal of the baffle from the ceiling.

The gripping tool used to install and remove the air guard assembly from the metal supports surrounding the air diffuser has a body attached to the end of an elongated pole. The pole has a plurality of telescoping sections so that the pole length can be varied as necessary. The body has a first jaw having an inwardly directed lip or end portion that engages the baffle when the tool is in the gripping position relative to the baffle. A second jaw is connected to an arm that is pivotally mounted on the body. The second jaw has an inwardly directed lip or end portion that engages the baffle when the first and second jaws are moved into gripping relation with the baffle. The end portion of the first jaw is longitudinally spaced from the end portion of the second jaw when the jaws are moved together to increase the gripping action of the tool. The baffle can be adjustably mounted on the gripping tool to allow the tool to grip the baffle at an angle when vertical access to the diffuser is limited. A spring engages the body and arm to bias the second jaw toward the first jaw. A cord attached to the arm is pulled downwardly to open the jaws. The tool enables the air guard assembly to be mounted on the metal ceiling structure adjacent the air diffuser from a floor level.

DESCRIPTION OF THE DRAWING

FIG. 15 is a perspective view of a second modification of the baffle of FIG. 4;

FIG. 16 is an enlarged end view of FIG. 15;

FIG. 17 is a foreshortened and enlarged side view of FIG. 15;

FIG. 18 is a sectional view taken along the line 18—18 of FIG. 17;

FIG. 19 is a foreshortened and enlarged top view of FIG. 15; and

FIG. 20 is a foreshortened and enlarged bottom view of FIG. 15.

DESCRIPTION OF PREFERRED EMBODIMENTS

Figure 1:
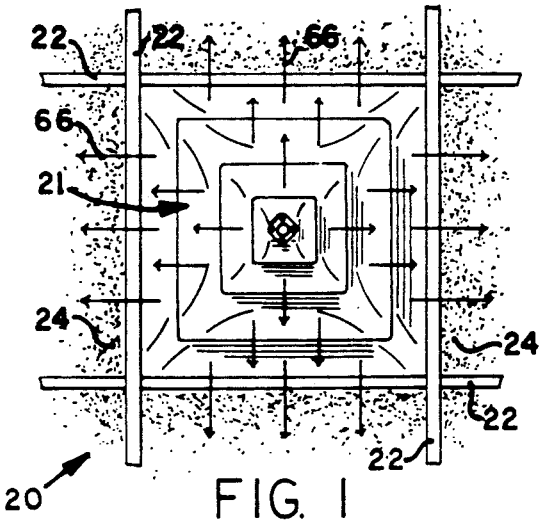
FIG. 1 is a plan view of a panel ceiling having a conventional air diffuser.
Figure 2:
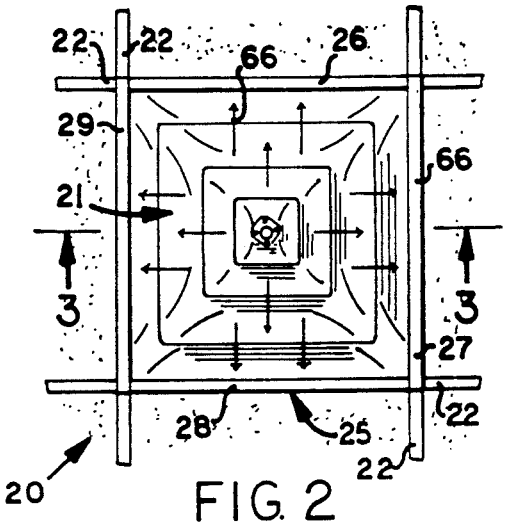
FIG. 2 is a plan view of a ceiling having a conventional air diffuser equipped with the air guard assembly of the invention.
Figure 3:
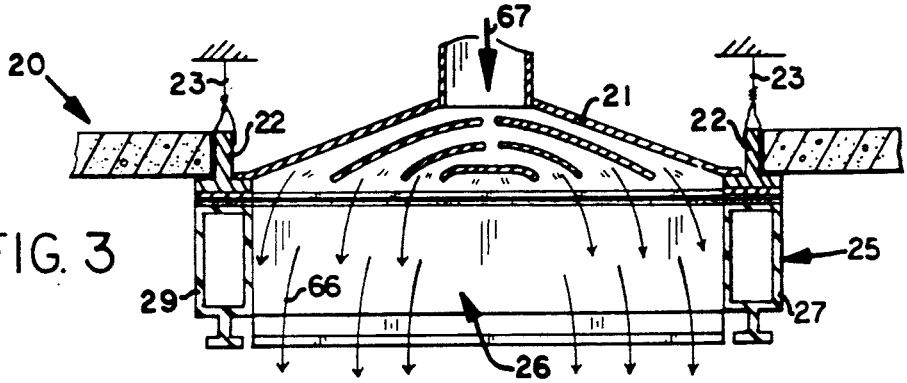
FIG. 3 is an enlarged sectional view taken along the line 3—3 of FIG. 2.

Referring to FIGS. 2 and 3, there is shown a panel ceiling 20 having an air diffuser 21 for circulating air from heating and air conditioning vents in a building, such as a retail store, school, office building and the like. Diffuser 21 is a conventional structure for accommodating air from an air duct and directs air in an outward direction generally parallel to ceiling 20 as shown by arrows 66 in FIGS. 1 and 2. As shown in FIG. 1, air borne particulates, dust and dirt 24 collects on the surrounding panels of ceiling 20 adjacent diffuser 21. The panels of ceiling 20 can also be contaminated with smoke and foreign gases carried by the air discharged from diffuser 21. Soiled panels of the ceiling require cleaning and may have to be replaced which consumes time, labor and funds.

An air guard assembly of the invention, indicated generally at 25 removably mounted on ceiling 20 operates to force air downward away from the ceiling toward the floor of the building. Air guard assembly 25 also prevents build-up of air borne particulates, dust and dirt 24 on the panels of ceiling 20 surrounding diffuser 21. Air guard assembly 25 has magnetic properties that enable it to be magnetically supported on metal ceiling structure surrounding diffuser 21. Assembly 25 can be easily and quickly installed and removed from ceiling 20. An installer or worker 64 standing at floor level uses a gripping tool 40 having an elongated handle 63 to install and remove assembly 25. Vertical access to diffuser 21 is not required to install air guard assembly 25 as herein described.

Referring to FIGS. 2 and 3, air guard assembly 25 has a plurality of elongated air guards or baffles 26, 27, 28 and 29 releasably supported on metal strips 22 normally used to carry the tiles or panels of ceiling 20. Each strip 22 has a generally T-shaped cross section and is supported from the beam structure of the building with a plurality of cords or wires 23. Baffles 26–29 are positioned on strips 22 surrounding the outer peripheral edge of diffuser 21. Air forced outwardly from diffuser 21 is directed downwardly toward the floor by baffles 26–29 as shown by arrows 66 in FIG. 3. This increases heat energy efficiency as hot air is not directed along ceiling 20, but down toward the floor. As shown in FIG. 2, baffles 26 and 28 extend between the ends of baffles 27 and 29 whereby diffuser 21 is enclosed within air guard assembly 25. The lengths of baffles 26 and 28 are slightly shorter than the lengths of baffles 27 and 29. There is a tight close relationship between the ends of baffles 26–29 so that dirt 24 and air flowing from diffuser 21 does not leak through assembly 25 and collect on adjacent panels of ceiling 20. This eliminates the need for periodic cleaning procedures and replacement of soiled panels surrounding diffuser 21.

Figure 4:
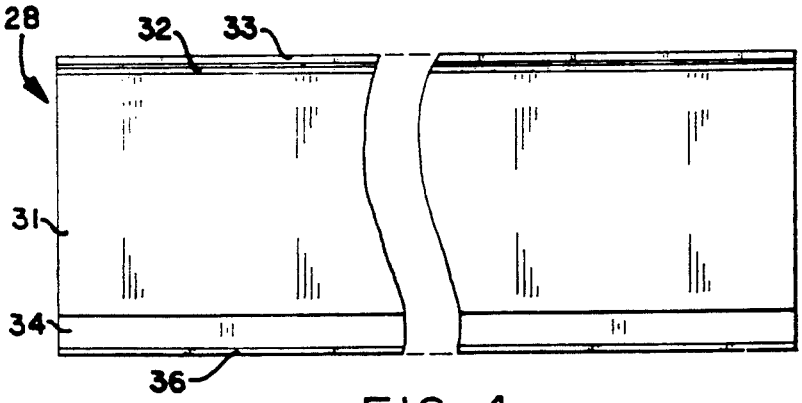
FIG. 4 is a foreshortened side elevational view of a baffle of the air guard assembly of FIG. 2.
Figure 5:
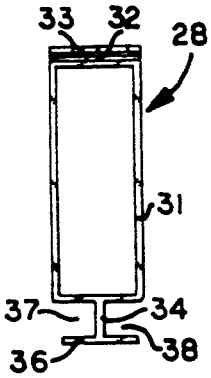
FIG. 5 is an end elevational view of the baffle.
Figure 6:
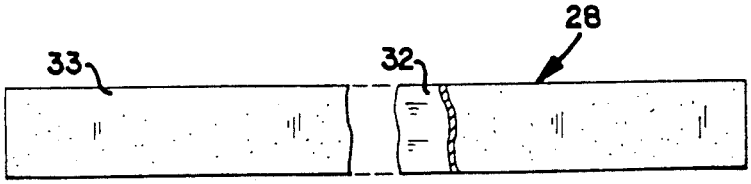
FIG. 6 is a foreshortened top view of the baffle of FIG. 4.

Referring to FIGS. 4, 5 and 6, baffle 28 has an elongated rectangular body 31 having a generally horizontal top surface 32 that supports a magnet 33. Body 31 is a hollow rectangular member. A vertical flat neck or flange 34 is joined to bottom of body 31. The lower edge of neck 34 is joined to a transverse shoulder 36. The body 31, neck 34 and should 36 is a one-piece member. Baffle 28 has substantially the same structure as baffles 27–29. The following description is limited to baffle 28.

Baffle 28 is a one-piece structure preferably made of extruded plastic or non-magnetic metal, such as aluminum. The material of baffle 28 can be clear or a solid color, such as white. Magnet 33 is a generally flat elongated plastic strip having a permanent magnetic field impressed thereon. A strip suitable for magnet 33 is produced by B.F. Goodrich Company, Marieita, Ohio, under the name KOROSEAL. KOROSEAL is a plastic composition capable of being easily flexed, can be securely cemented to various types of material, and is available in various widths, thicknesses, and lengths. Magnet 33 is adhesively secured to top surface 32 of body 31. The width of magnet 33 is substantially the same as the width of surface 32, as shown in FIG. 6. The ends of magnet 33 are flush with the ends of top surface 32.

As shown in FIG. 5, baffle 28 has a downwardly directed, flat neck 34 that extends between the bottom of body 31 and a transverse shoulder 36. Grooves 37 and 38 located between body 31 and shoulder 36 accommodate jaws 42 and 51 of gripping tool 40 to prevent jaws 42 and 51 from slipping off baffle 28 during installation and removal of baffle 28 from ceiling 20. Thus, baffle 28 cannot inadvertently fall and hit worker 64 or fall on the floor.

Figure 9:
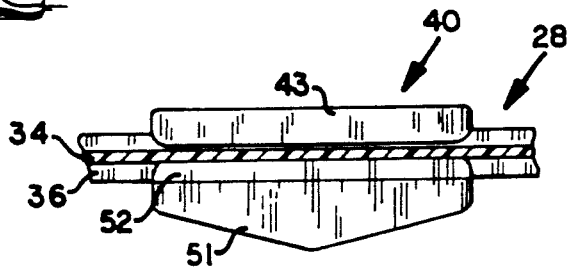
FIG. 9 is a sectional view taken along the line 9—9 of FIG. 8.
Figure 10:
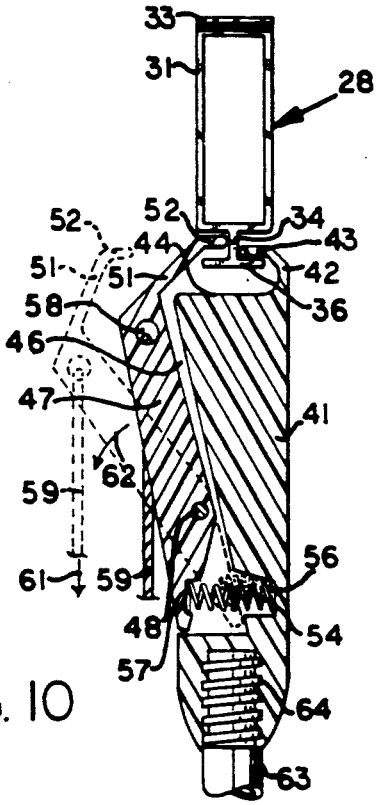
FIG. 10 is a sectional view taken along the line 10—10 of FIG. 8.
Figure 11:
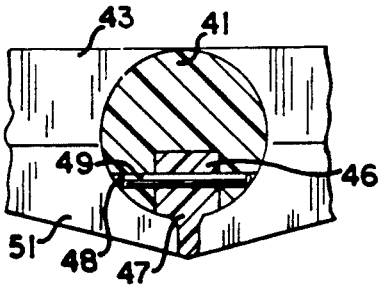
FIG. 11 is a sectional view taken along the line 11—11 of FIG. 8.

Referring to FIGS. 7 to 11, there is shown a gripping tool, indicated generally at 40 used to install and remove air guard assembly 25 from metal strips 22. Tool 40 has a generally cylindrical body 41 having a generally flat top wall 44. Body 41 has a first jaw 42 having a lip 43 that curves upwardly and inwardly from one end of top wall 44. As shown in FIG. 11, body 41 has a groove 46 that accommodates an elongated, generally rectangular arm 47. Groove 46 extends downwardly and inwardly from top wall 44. A pin 48 located in a bore 49 extending laterally through body 41 and arm 47 pivotally connects arm 47 to body 41. The upper end of arm 47 has an upwardly inclined second jaw 51 having an inwardly directed lip 52. Jaws 42 and 51 cooperate to grip baffles 26–29.

Referring to FIG. 10, a coil spring 54 is accommodated by pockets 56 and 57 in the lower portions of body 41 and arm 47, respectively. Pockets 56 and 57 are transversely aligned and located below pin 48. The ends of spring 54 engage the lower portions of body 41 and arm 47 thereby biasing the lower portion of arm 47 away from body 41. This causes jaw 51 to be biased toward jaw 42.

The upper portion of arm 47 has a hole 58 for a rope or cord 59. Pulling downwardly on cord 59, as indicated by arrow 61 in FIG. 10, causes the upper portion of arm 47 to pivot away from body 41, as indicated by arrow 62 in FIG. 10, and opens jaws 42 and 51. The position of arm 47 when cord 59 is pulled down to open jaws 42 and 51 is shown in broken lines in FIG. 10. The lower portion of arm 47 has an inclined edge that engages the bottom surface of groove 46 when arm 47 is pivoted to open jaws 42 and 51.

Figure 7:
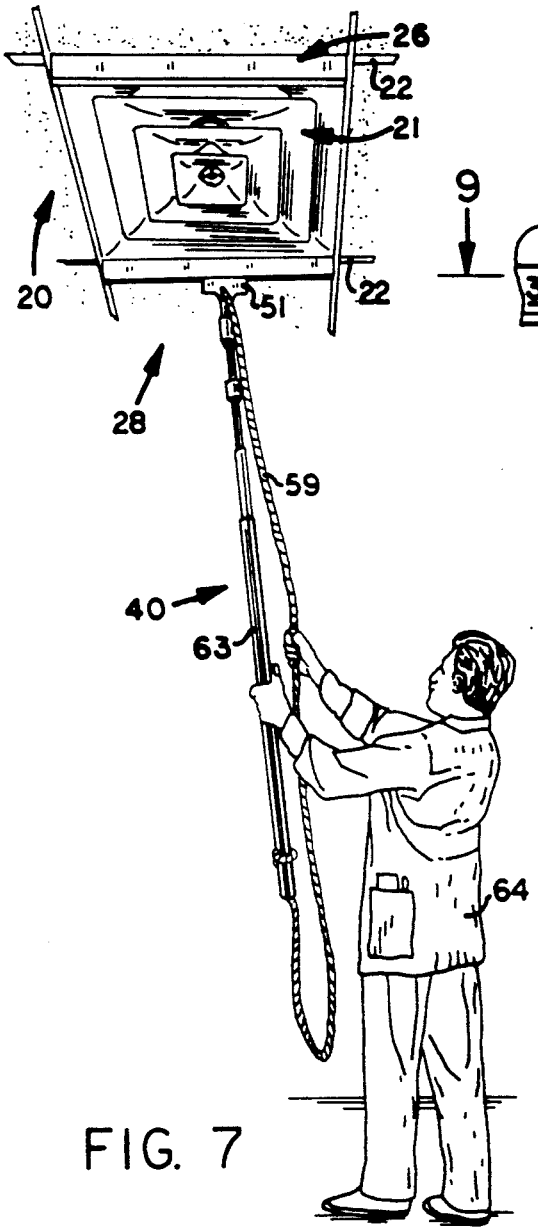
FIG. 7 is a diagrammatic view showing the tool used to mount the baffle on the ceiling and remove the air guard from the ceiling.
Figure 8:
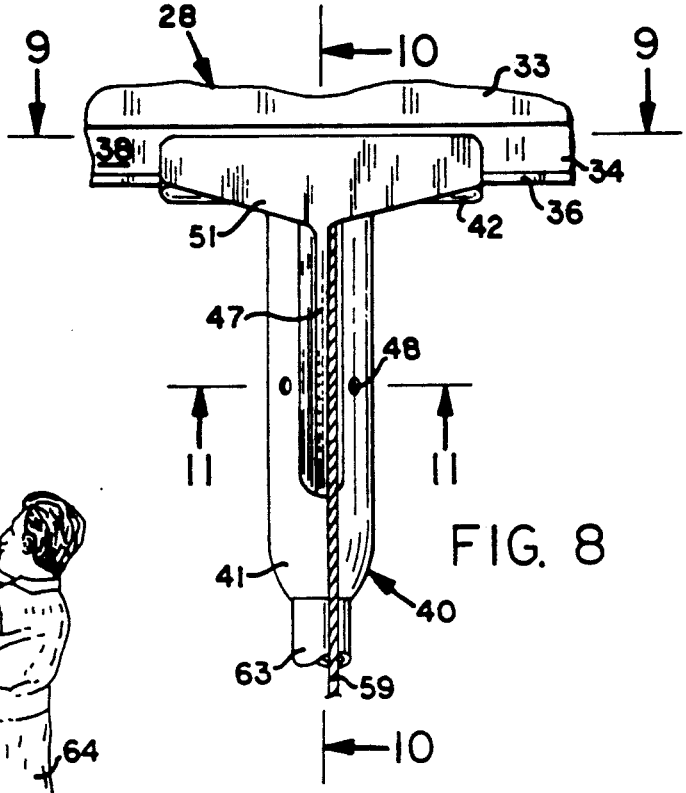
FIG. 8 is an elevational view of the head end of the gripping tool used to install and remove the baffle from the ceiling metal support.

An elongated handle or pole 63 connected to body 41 allows operator 64 to position baffles 26–29 on metal strips 22 surrounding diffuser 21 from floor level. As shown in FIG. 10, pole 63 has a threaded upper end that is turned into a threaded socket 64 in the bottom of body 41 to attached pole 63 to body 41. Pole 63 can have a plurality of telescoping sections to allow the length of the pole to be varied relative to the height of ceiling 20, as shown in FIG. 7.

In use, cord 59 of tool 40 is pulled in a downward direction, as indicated by arrow 61 in FIG. 10, to pivot arm 47 away from body 41 and open jaws 42 and 51. With jaws 42 and 51 open, the lower part of baffle 28 is placed between the jaws. The outer edges of jaws 42 and 51 can engage the opposite side of body 31 or be located in grooves 37 and 38 in engagement with neck 34. Body 41 can be angularly positioned adjacent baffle 26 whereby lip 43 of jaw 42 extends into groove 37 and engages the lower portion of neck 34 adjacent the top of shoulder 36. The pulling force on cord 59 is released allowing spring 54 to move arm 47 toward body 41 whereby lip 52 of jaw 51 extends into groove 38 and engages the upper portion of neck 34 adjacent the bottom of body 31. As shown in FIG. 10, lip 52 is located above and longitudinally spaced from lip 43 when jaws 42 and 51 are moved to the gripping position. Jaws 42 and 51 engage opposite sides of neck 34. Spring 54 holds jaws 42 and 51 in a right gripping relation with neck 34.

Grooves 37 and 38 prevent jaws 42 and 51 from slipping off baffle 26. As shown in FIG. 9, edge 45 of lip 43 and edge 53 of lip 52 are located adjacent opposite sides of neck 34 below body 31 and above shoulder 36 when jaws 42 and 51 are in the gripping position. Pole 63 is used to elevate baffles 26 adjacent metal strip 22. Magnet 33 adheres to strip 22 to mount baffle 26 on ceiling 20 adjacent diffuser 21. Cord 59 is pulled downwardly to open jaws 42 and 51 so that tool 40 can be separated from baffle 26. Baffles 27–29 are installed on ceiling 20 in a like manner. Baffles 26–29 are assembled in an end-to-end relationship to enclose diffuser 21 within air guard assembly 25. The ends of baffles 26–29 have a tight fit to prevent air and dirt 24 from leaking through air guard assembly 25 and soiling adjacent areas of ceiling 20. Hot or cold air forced through diffuser 21, as shown by arrow 67 in FIG. 3, is diffused outwardly and engages baffles 26–29. Baffles 26–29 divert air downwardly toward the floor of the building.

Gripping tool 40 can be adjusted to hold baffles 26–29 at an angle whereby worker 64 is not required to be directly below diffuser 21 to mount air guard assembly 25 on ceiling strips 22 surrounding diffuser 21. This allows placement of air guard assembly 25 in areas where vertical access to diffuser 21 is limited by counters, benches and the like.

When air guard assembly 25 becomes soiled, tool 40 can be used to remove assembly 25 from ceiling 20 for cleaning. To remove guard assembly 25 from ceiling 20, jaws 42 and 51 are opened with cord 59. Jaw 42 is moved adjacent baffle neck 34. Closing jaws 42 and 51 moves the jaws into gripping relation with neck 34. Magnet 33 is pulled away from metal strip 22. Grooves 37 and 38 prevent jaws 51 from slipping thereby preventing the baffle from falling and hitting worker 64 in the head.

Figure 12:
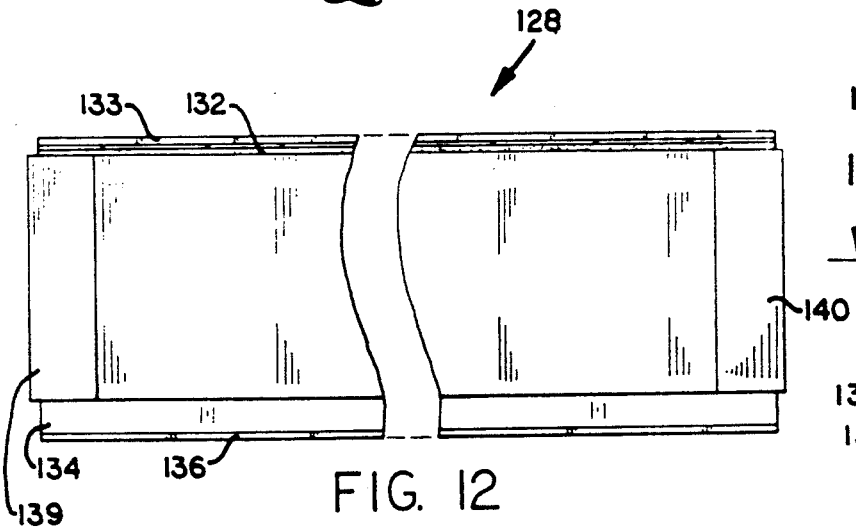
FIG. 12 is a foreshortened side elevational view of a first modification of the baffle of FIG. 4.
Figure 13:
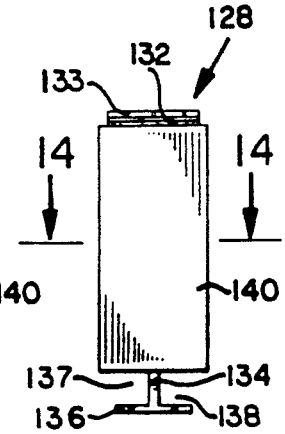
FIG. 13 is an end view of the baffle of FIG. 12.
Figure 14:
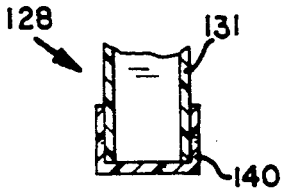
FIG. 14 is a sectional view taken along the line 14—14 of FIG. 13.

Referring to FIGS. 12 to 14, there is shown a first modification of the guard member or baffle of the invention indicated generally at 128. Baffle 128 is a one-piece structure preferably made of extruded plastic or non-magnetic metal, such as aluminum. The material of baffle 128 can be clear or a solid color, such as white. Baffle 128 has a generally rectangular body 131 having a flat top surface 132 and flat sides. A downwardly directed neck or rib 134 is joined to the bottom of body 131. A transverse shoulder or lip 136 is attached to the lower edge of neck 134 to provide longitudinal grooves 137 and 138 between the lower end of body 131 and shoulder 136. Grooves 137 and 138 located between the lower end of body 131 and shoulder 136 accommodate jaws 42 and 51 of gripping tool 40 to prevent jaws 42 and 51 from slipping off baffle 128 during installation and removal of baffle 128 from ceiling 20. Thus, baffle 128 cannot inadvertently fall and hit worker 64 or fall on objects or the floor adjacent the worker.

A magnet or plastic strip 133 having magnetic materials is mounted on top of surface of 132 of body 131. Magnet 133 is a generally flat elongated plastic strip having a permanent magnetic field impressed thereon. A strip suitable for magnet 133 is produced by B.F. Goodrich Company, Marieita, Ohio, under the name KOROSEAL. KOROSEAL is a plastic composition capable of being easily flexed, and securely cemented to various types of material, and is available in various widths, thicknesses, and lengths. Magnet 133 is adhesively secured to top surface 132 of body 131. The width of magnet 133 is substantially the same as the width of surface 132, as shown in FIG. 13. The ends of magnet 133 are flush With the ends of top surface 132.

Body 131, neck 134, and shoulder 136 are made from one-piece extruded material, such as plastic or aluminum. Body 131 is a hollow generally rectangular member having open ends. Caps 139 and 140 mounted on opposite ends of body 131 close the open ends of body 131. Caps 139 and 140 are U-shaped members that fit over adjacent sides of body 131 as seen in FIG. 14. Bonding material or an adhesive Can be used to secure caps 139 and 140 to body 131. Caps 139 and 140 improve the appearance of the baffle assembly without effecting its function of directing air and air borne particulates away from the ceiling.

Baffle 128 is used with additional baffles to construct an air guard assembly as directed above with respect to baffles 26 to 29. Tool 40 is used to install and remove the baffles from the metal ceiling supports for the ceiling panels in the same manner as described with respect to baffles 26 to 29.

Referring to FIGS. 15–20, there is shown a second modification of the guard member or baffle of the invention indicated generally at 228. Baffle 228 is a one-piece structure preferably made of extruded plastic or non-magnetic metal, such as aluminum. The material of baffle 228 can be clear or a solid color, such as white. Baffle 228 has a generally rectangular body 231 having a flat top surface 232 and opposite flat sides as seen in FIG. 18. The lower portion of baffle 228 has a downwardly directed neck or rib 234 joined to an outwardly directed shoulder or lip 236. The lip 236 has a width that is the same as the width as body 231. The opposite sides of baffle 228 have longitudinal grooves 237 and 238 formed by the neck 234, body 231 and shoulder 236. The edges of grooves 237 and 238 are square and sharp. Grooves 237 and 238 have a depth, such as at least an eighth of an inch to accommodate the jaws 42 and 51 of gripping tool 40 to prevent the jaws 42 and 51 from slipping off baffle 228 during the installation and removal of baffle 228 from ceiling 20. Thus, baffle 228 cannot inadvertently fall and hit a worker 64 or fall on objects or hit the floor adjacent the worker.

A magnet or plastic strip 233 having magnetic materials is secured to top surface 232 of body 231 with a layer of adhesive 235. Other structures can be used to secure magnet 233 to the top of body 231. Magnet 233 is a generally flat elongated plastic strip having a permanent magnetic field impressed thereon. A strip suitable for magnet 233 is produced by B.F. Goodrich Company, Marieita, Ohio, under the name KOROSEAL. KOROSEAL is a plastic composition capable of being easily flexed and securely cemented to various types of material, and is available in various widths, thicknesses and length. The width of magnet 233 is substantially the same as the width of the surface 232 as shown in FIG. 18. The ends of magnet 233 are flush with the ends of top surface 231.

Body 231, neck 234, and shoulder 236 are made from a one-piece extruded material, such as plastic or aluminum. Body 231 is a hollow generally rectangular member having open ends. Caps 239 and 240 mounted on opposite ends of body 231 close the open ends of body 231. Caps 239 and 240 are U-shaped members that fit over adjacent sides of body 231 as seen in FIGS. 19 and 20. Bonding material or an adhesive can be used to secure caps 239 and 240 to body 231. Caps 239 and 240 improve the appearance of baffle assembly without affecting its function of directing air and air borne particulates away from the sealing.

Baffle 228 is used with additional baffles to construct an air guard assembly as described above with respect to baffles 26–29. Tool 40 is used to install and remove the baffles from the metal ceiling supports for the ceiling panels in the same manner with respect to baffles 26–29. As seen in FIGS. 17, 18 and 20 the bottom surface of shoulder 236 is horizontal and flat. The bottom surface is located adjacent the top wall 44 of the tool 40 thereby stabilizing the baffle 228 on the tool 40 when the jaws 43 and 52 are located in the grooves 237 and 238. End caps 239 and 240 provide stop edges at opposite ends of the grooves 237 and 238 thereby prevent lateral slipping of the tool out of the grooves 237 and 238.

While there has been shown and described preferred embodiments of the air guard assembly of the invention, it is understood that changes in structure, arrangement of structure, and materials may be made by those skilled in the art without departing from the invention. The invention is defined in the following clams.

I claim:

1. An apparatus for directing air and dirt flowing from an air diffuser from a ceiling surface including magnetic holding means comprising: a plurality of elongated members mounted on the ceiling, each member having body means, neck means extending from the body means and shoulder means joined to the neck means defining groove means, and magnet means secured to the body means releasably attachable to magnetic holding means, the magnet means having a continuous top surface extending between opposite ends of the body means thereby releasably holding the member on the magnetic holding means adjacent the diffuser.

2. The apparatus of claim 1 wherein: the body means comprises a tubular body having a generally flat top surface, and means securing the magnet means to the top surface.

3. The apparatus of claim 2 wherein: the magnet means comprises a generally flat strip of plastic magnetic material.

4. The apparatus of claim 1 wherein: the members surrounding the air diffuser have generally vertical surfaces projected downwardly from the ceiling surface.

5. The apparatus of claim 4 wherein: each member has ends, said ends of the adjacent members located in close overlapping relationship.

6. An apparatus for directing air and dirt moving from an air dispenser away from a ceiling surface including magnetic holding means comprising: first baffle means mounted on the surface, second baffle means mounted on the surface laterally spaced from the first baffle means, third baffle means mounted on the surface extended between the first and second baffle means, fourth baffle means mounted on the surface extended between the first and second baffle means and laterally spaced from the third baffle means, said first, second, third and fourth baffle means surrounding the air dispenser, each baffle means having body means, a neck secured to the body means and shoulder means joined to the neck to define a groove, and magnet means secured to the body means releasably attachable to the magnetic holding means on the surface, the magnet means having a continuous top surface extending between opposite ends of the body means thereby releasably holding the baffle means on the surface adjacent the air dispenser and preventing leakage of air and dirt leaving the air dispenser laterally through the baffle means.

7. The apparatus of claim 6 wherein: the body means comprises a tubular body having a generally flat top surface, and means securing the magnet means to the top surface.

8. The apparatus of claim 7 wherein: the magnet means comprises a generally flat strip of plastic magnetic material.

9. The apparatus of claim 6 wherein: the first, second, third and fourth baffle means have generally vertical surfaces projected downwardly from the air dispenser mounted on the ceiling surface to direct downwardly air and dirt flowing through the dispenser.

10. The apparatus of claim 6 wherein: the first and second baffle means have substantially the same lengths, the third and fourth baffle means having substantially the same lengths, the lengths of the first and second baffle means being shorter than the lengths of the third and fourth baffle means.

11. An air control apparatus for an air diffuser releasably supported on a metal ceiling surface, the air control apparatus adapted to be located adjacent the ceiling surface for attachment thereto with gripping means, comprising: a plurality of elongated members surrounding the diffuser, each member having a tubular body, neck means attached to the body and shoulder means attached to the neck means defining a groove, the body having a continuous flat top surface having opposite ends, and magnetic means secured to the body releasably attachable to the metal ceiling surface, the magnetic means comprising a generally flat strip of magnetic material secured to the top surface of the body, the strip having a continuous top surface extending between the ends of the body thereby retaining the member on the ceiling surface adjacent the diffuser and minimizing leakage of air and dirt leaving the air dispenser laterally through the baffle means.

12. The apparatus of claim 11 wherein: the neck is a flat member secured to the body and extends from the body to the should means.

* * * * *